United States Patent [19]

Volker et al.

[11] Patent Number: 4,630,873

[45] Date of Patent: Dec. 23, 1986

[54] APPARATUS FOR LOW TEMPERATURE STORAGE OF BIOLOGICAL OR PHARMACEUTICAL SAMPLES

[75] Inventors: Wolfgang Volker, Tonisvorst; Klemens Thoma, Krefeld-Huls, both of Fed. Rep. of Germany

[73] Assignee: Messer Griesheim GmbH, Frankfurt, Fed. Rep. of Germany

[21] Appl. No.: 664,318

[22] Filed: Oct. 24, 1984

[30] Foreign Application Priority Data

Nov. 24, 1983 [DE] Fed. Rep. of Germany ..... 3342489

[51] Int. Cl.[4] ..... F25D 3/10

[52] U.S. Cl. ..... 312/209; 312/348

[58] Field of Search ..... 220/21, 22, 353, 352, 220/356; 312/209, 119, 348; 211/60.1

[56] References Cited

U.S. PATENT DOCUMENTS

| | | | |
|---|---|---|---|
| 774,879 | 11/1904 | Hullhorst | 312/209 |
| 1,093,677 | 4/1914 | Ashley | 220/356 |
| 2,465,644 | 3/1949 | Graves | 220/356 |
| 2,730,423 | 1/1956 | Mock . | |
| 3,082,050 | 3/1963 | Baxter et al. | 312/209 |
| 3,327,885 | 6/1967 | Carle et al. | 220/21 |
| 3,599,865 | 6/1952 | Rudman | 312/348 |

*Primary Examiner*—William E. Lyddane
*Assistant Examiner*—Joseph Falk
*Attorney, Agent, or Firm*—Connolly and Hutz

[57] ABSTRACT

The low temperature storage of biological or pharmaceutical samples by means of ampullas in a low temperature container should be as compact and easy to handle as possible. For this purpose, cases are arranged in such a container into which boxes containing the ampullas can be placed. Each box has pins on the inside, the center distance of which is equal to the outside diameter of the ampullas and in which the minimum distance from any opposing side walls of the box is equal to the whole number multiple of the outside diameter of the ampullas.

10 Claims, 5 Drawing Figures

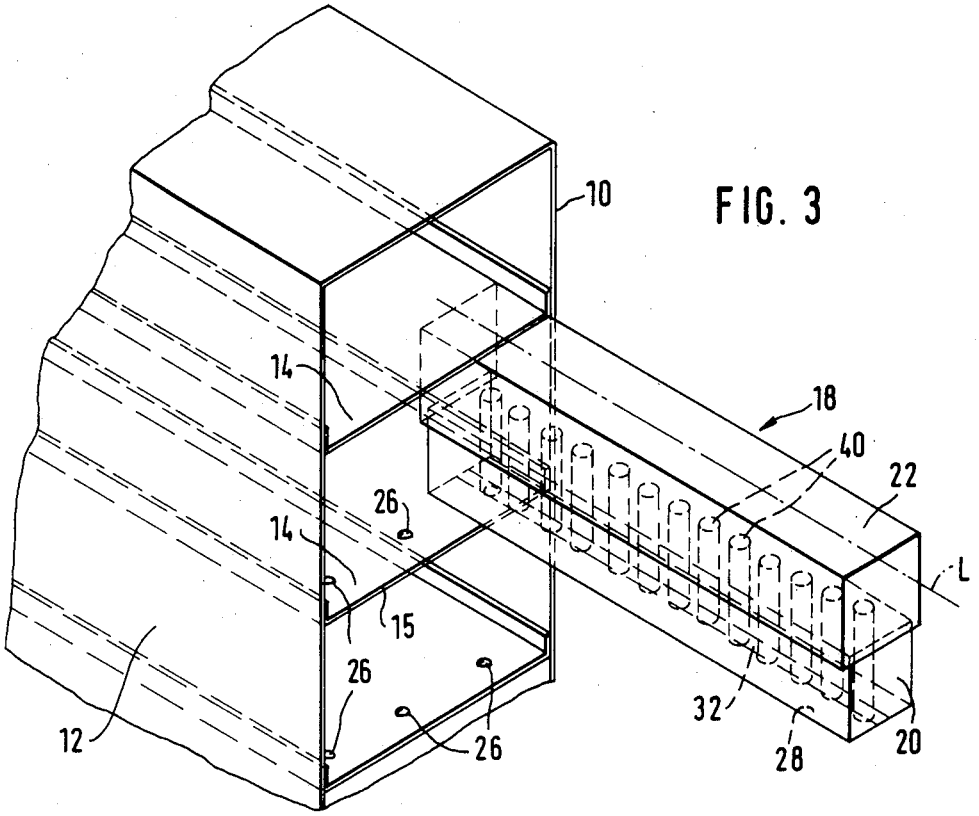
FIG. 3
FIG. 4
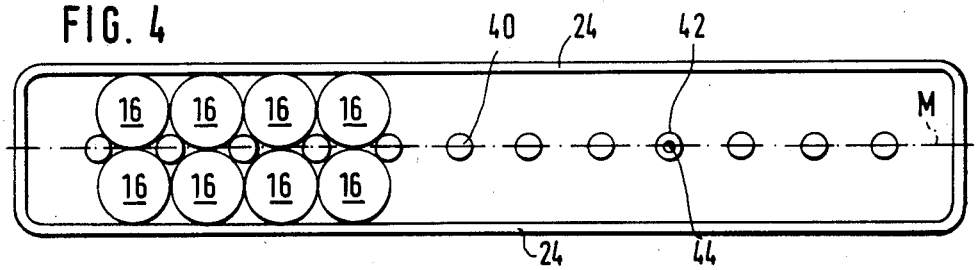
FIG. 5
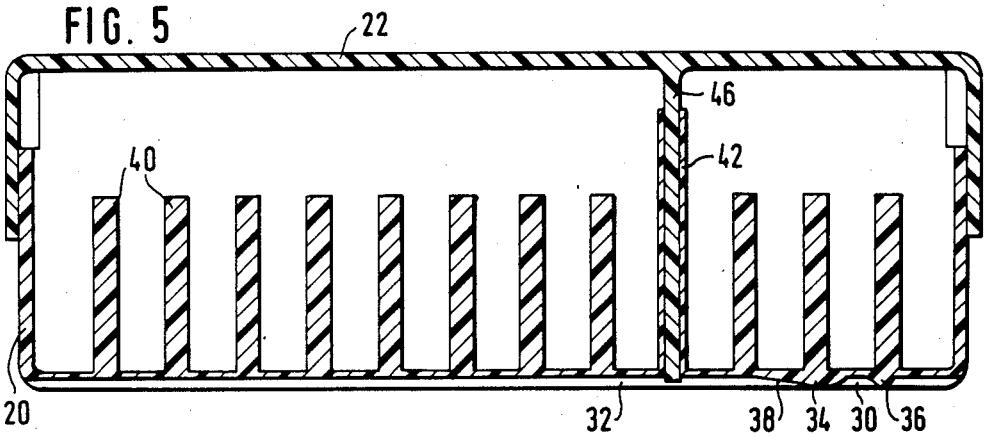

APPARATUS FOR LOW TEMPERATURE STORAGE OF BIOLOGICAL OR PHARMACEUTICAL SAMPLES

BACKGROUND OF THE INVENTION

The invention relates to an apparatus for low temperature storage of biological or pharmaceutical samples.

These types of samples are stored for preservation in ampullas which in turn are kept in well insulated containers, the inside of which is kept at the desired low temperature by means of liquid nitrogen.

On one hand, it is desirable for economical reasons to accommodate the ampullas in these containers as space-saving as possible. On the other hand, it must be certain that any random ampulla can be simply removed from the storage container for further use.

Storage of ampullas in grid-like holders is known which are a component of sliding drawers whereby the drawers in turn are again a component of cabinet-like cases.

In this type of storage, the ampullas are spatially separated by rods or walls of the grid-like holders so that the space requirement of each ampulla is increased.

SUMMARY OF THE INVENTION

The invention is based on the object of finding a compact and easy to hand type of ampulla storage. This object is met by a section-like apparatus wherein the ampullas are placed in boxes by a section-like apparatus wherein the ampullas are placed in boxes separated by pins in each box.

The pins arranged in each box normally have the same length. The place of each ampulla with respect to the pin, and, therefore, inside the box can be exactly established by a defined unequal pin length.

In order to secure the contents of the box against unauthorized or unintentional opening, it may be desirable to seal the box. For this purpose, a box consisting, for example, of ND-PE can be sealed so that one of the pins fastened to the bottom plate has a longitudinal bore and an additional pin is fastened on the inside of the cover plate and positioned over this pin which passes through the longitudinal bore through the bottom plate which in this location is also drilled through so that this pin can be welded to the bottom plate with the result that the upper and lower part of the box cannot be separated from each other without difficulty.

For a compact, secure ampulla storage it is, furthermore, advantageous to construct each of the tower-like cases which can be inserted in the container completely open on at least two of their opposing sides so that the length of each of the boxes to be stored on the partitions of the cases can have exactly the same length as the distance of the opposing open sides of each case.

It is also advantageous when the minimum distance of this partition of a case is not greater than required by the height of a box. As a result, it is additionally prevented that boxes which are stored in liquid nitrogen float up and may consequently change their storage place uncontrolled.

The positional securing the boxes and consequently of the ampullas is advantageously increased by the fact that each partition has at least one projection which can be engaged in a recess arranged in the partition and/or bottom plate of the upper, respectively, lower part of a box.

This engagement can be especially advantageously arranged in a groove-like recess extending in the inside of the box positioned near the pins.

Since the boxes with their engagement can only be inserted with one of their sides in one projection of the partition, the boxes can be defined by position with respect to their "front" and "back". As a result, the possibility of exactly defining the storage place of each ampulla is also improved.

THE DRAWINGS

FIG. 3 shows a partial view of a case in perspective according to FIG. 2 with a partly inserted box;

FIG. 4 shows a systematic plan view of the inside space of the box according to FIG. 3; and FIG. 5 shows a cross section along line L in FIG. 3.

DETAILED DESCRIPTION

Figure 1:
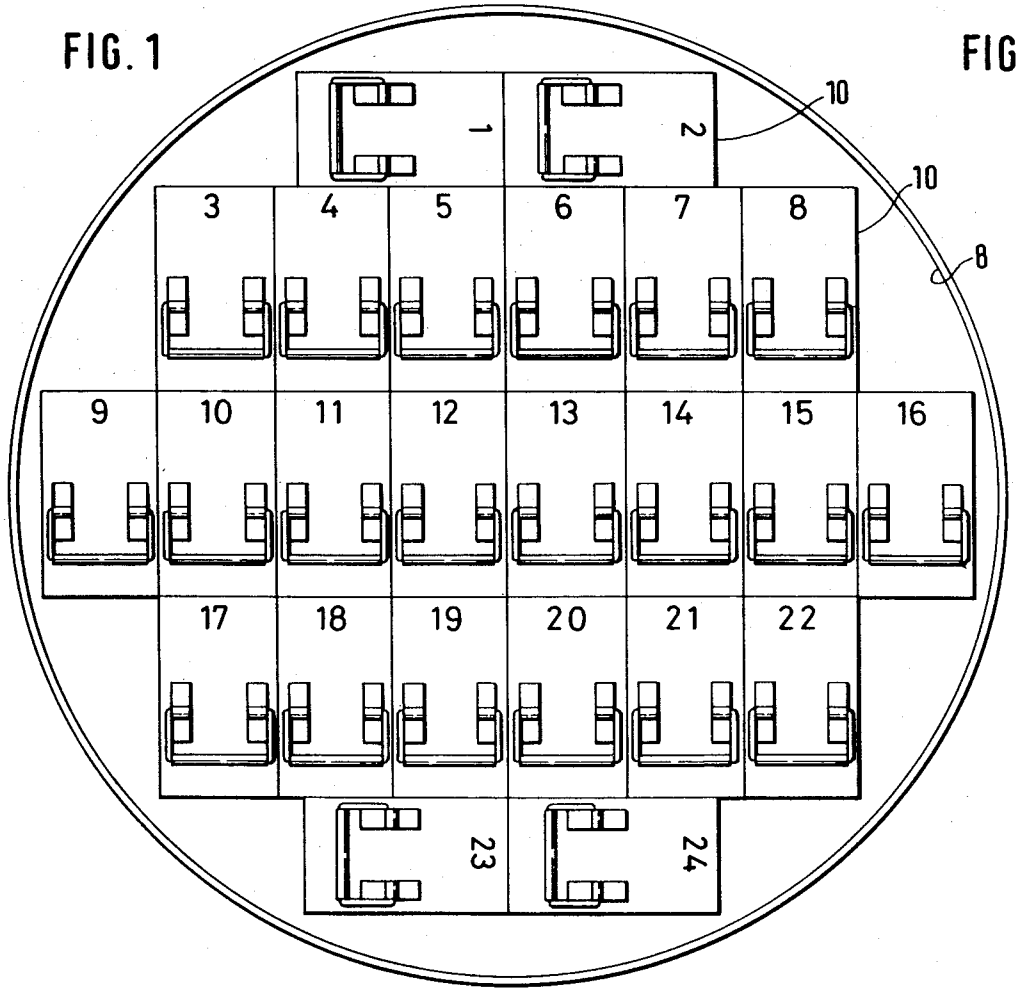
FIG. 1 is a systematic plan view of the inside space of a container containing 24 cases.

In FIG. 1 the inside wall of a container for storing, in this case, 24 tower-like cases is indicated with 8. These cases are stored at low temperature in the container selectively in the gas or liquid phase of nitrogen. Each of the cases 10 has a number on the top: 1, 2, 3 . . . 24 for their identification. A carrying handle is provided on the top of the cases 10 to easily lift the cases from the container.

Figure 2:
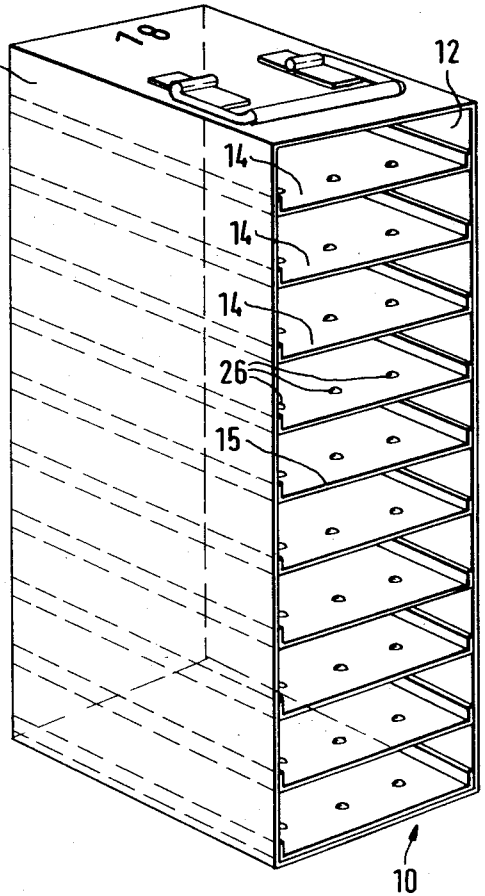
FIG. 2 shows a perspective view of the case of FIG. 1.

One of the cases (No. 18) is shown in FIG. 2. The case 10 has a rectangular plan and is completely open on two opposing sides. In the case, partitions 14 above one another are arranged and are provided with projections 26. Boxes 18 can be engaged in these projections. The projections 26 are equally far removed from the edge of the partition 15.

The box consists of an upper part 22 and a lower part 20 (FIG. 3). In the bottom plate 28 of the lower part 20, a groove-like recess 32 has been stamped which extends over almost the entire length of the box. The box is guided by this recess 32 of the projection 26 during insertion on the partition 14 in the case 10. In cross direction of the box 18, the projections 26 are provided at a distance from each other on the partition 14 which corresponds to the maximum outside dimension of a case. The case 10 shown in FIG. 2, resp. 3 is, therefore, designed each time for three boxes 18 arranged next to each other. Any number of boxes may, of course, be accommodated next to each other on the partitions 14 of each case 10.

The height distance of the partitions 14 from each other corresponds to the maximum height of the box 18 in closed condition. As a result, the box maintains a light contact pressure with the two partitions 14 defining the box below and above during insertion into the case and during storage. Cases which are stored in the liquid phase of the medium cooling the container 8 can, therefore, not float up.

Inside the lower part 20 of the box 18, pins 40, 42 (FIG. 5) are arranged. These pins are removed equally far from the side walls 24 of the lower part 20. The center distance of these pins from these side walls 24 as well as from each other is the same as the outside diameter of the ampoules or ampullas 16 to be stored in the box 18. Several rows of pins can, of course, also be arranged parallel to each other in one box. By means of these pins and, where applicable, the outside wall of the box, the ampullas are unambigously fixed in their intended position so that sliding or tipping over of the ampullas in the box is prevented. The pins 40 generally have the same height, but the pins may also have different lengths. As a result of this type of defined unequal pin length, the exact position of a certain pin in the box, and, therefore, also the exact position of each ampulla in this box can be determined.

Many applications may require that the box is protected against unauthorized or unintentional opening. For this purpose, a pin 46 fastened to the upper part 22 projects through a longitudinal bore 44 of a pin 42 fastened in the lower part 20 into the groove-like recess of the bottom plate 28 so that the pin 46 can be fastened to the bottom plate 28 on the bottom. A box made of ND-PE is suitable in this case of low temperature storage. A box produced from this material can now be easily sealed by welding this pin 46 on the bottom to the bottom plate 28. As a result, the box 18 can only be opened by destroying the seal or by separating the pin 46 from the upper part 22.

The groove-like recess 32 (FIG. 5) has cross walls at two locations 34, 36 so that a recess 30 is produced in between in which a projection 26 of the partition 14 can engage. One of the cross walls runs in a flat incline 38 in longitudinal direction of the box 18 into the recess 32 in contrast with the wall in location 36 so that the box 18 can only be inserted with one side over the projection 26 in the partition 14. This improves the possibility of positional definition of the ampullas in the box and consequently, ultimately, in the container 8 since the box 18 can also be characterized with respect to its "front" and "back".

What is claimed is:

1. An apparatus for the low temperature storage of biological or pharmaceutical samples by means of ampoules in a container having cases arranged in the container, wherein the cases are disposed one above the other and have extensible compartments for the storage of the ampoules, the improvement being each of said compartments consisting of a box having means for tightly packing at least two rows of the ampoules in each of said boxes, each of said boxes having a pair of side walls interconnected by a bottom plate, said means for tightly packing said ampoules including at least one row of pins extending upwardly from said bottom plate whereby a row of ampoules may be located on each side of said row of pins with the total number of rows of pins being one less than the number of rows of ampoules, the distance between the vertical axes of each pair of adjacent pins being equal to the distance of the vertical axis of each pin to the nearer of said side walls whereby ampoules having a diameter equal to said distance may be tightly placed between said pins and said side walls, each of said cases including two opposite and parallel side walls, a plurality of spaced flat partitions spanning said side walls of each of said cases, said boxes being stored on said flat partitions, the length of each box being no greater than the length of each of said flat partitions, the distance between adjacent flat partitions being slightly greater than the height of said boxes to minimize storage space, and each partition having a projection nested in a recess in each of said boxes.

2. Apparatus according to claim 1, characterized in that said box consists of a lower part comprising said bottom and side walls for receiving the ampoules, and an upper part which at least partly overlaps said side walls of said lower part.

3. Apparatus according to claim 2, characterized in that one of said pins fastened to the inside of said bottom plate has a longitudinal bore, an additional pin being fastened on the inside of said upper part passing through said longitudinal bore and through said bottom plate which is also drilled through at this location.

4. Apparatus according to claim 3, characterized in that said box consists of ND-PE.

5. Apparatus according to claim 1, characterized in that each case is completely open on at least two of its opposing sides.

6. Apparatus according to claim 7, characterized in that said projections provided next to each other are equidistant from said open sides of said case.

7. Apparatus according to claim 2, characterized in that said recess extending at least partly in the longitudinal direction and which is interrupted by cross walls at least in two locations.

8. Apparatus according to claim 7, characterized in that at least one of said cross walls ends in a flat incline in the longitudinal direction of the box in said recess.

9. Apparatus according to claim 1, in combination therewith, at least one row of cylindrical ampoules being disposed on each side of a row of said pins, each of said ampoules being in contact with at least two other of said ampoules and with at least two of said pins, and each of said ampoules having a diameter equal to said distance.

10. Apparatus according to claim 9, characterized in that said ampoules are stored in liquid nitrogen to provide said low temperature storage.

* * * * *